US007444088B2

(12) United States Patent
Radulski et al.

(10) Patent No.: US 7,444,088 B2
(45) Date of Patent: Oct. 28, 2008

(54) PRINTING SYSTEM WITH BALANCED CONSUMABLE USAGE

(75) Inventors: Charles Anthony Radulski, Macedon, NY (US); David G. Anderson, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 387 days.

(21) Appl. No.: 11/247,778

(22) Filed: Oct. 11, 2005

(65) Prior Publication Data

US 2007/0081828 A1 Apr. 12, 2007

(51) Int. Cl.
*G03G 15/08* (2006.01)

(52) U.S. Cl. ..... 399/27; 399/82

(58) Field of Classification Search ..... 399/8, 399/24, 27, 31, 82; 358/1.15, 1.16
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,170,340 A * 12/1992 Prokop et al. ..... 700/23
5,208,640 A 5/1993 Horie et al.
5,272,511 A 12/1993 Conrad et al.
5,287,194 A * 2/1994 Lobiondo ..... 358/296
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A * 9/1996 Yang et al. ..... 399/14
5,568,246 A 10/1996 Keller et al.
5,570,172 A 10/1996 Acquaviva (Continued)

FOREIGN PATENT DOCUMENTS

EP 1418747 A9 * 8/2004

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Robert Beatty
(74) *Attorney, Agent, or Firm*—Eugene O. Palazzo; Fay Sharpe LLP

(57) ABSTRACT

A printing system includes a plurality of marking engines. The marking engines selectively receive at least one replacement module, such as a toner or ink cartridge. The replacement module includes a consumable such as toner or ink, which is consumed during rendering of images by the respective marking engine. A scheduling system assigns images to the marking engines for rendering on a print medium, such as paper. The scheduling system has a mode of operation in which images are selectively assigned to the marking engines to balance usage of the consumable by the marking engines.

18 Claims, 4 Drawing Sheets

U.S. PATENT DOCUMENTS 5,596,416 A 1/1997 Barry et al.
5,617,214 A 4/1997 Webster et al.
5,629,762 A 5/1997 Mahoney et al.
5,636,032 A 6/1997 Springett
5,710,968 A 1/1998 Clark et al.
5,778,377 A 7/1998 Marlin et al.
5,867,198 A 2/1999 Gwaltney et al.
5,884,910 A 3/1999 Mandel
5,995,721 A 11/1999 Rourke et al.
6,016,409 A 1/2000 Beard et al.
6,059,284 A 5/2000 Wolf et al.
6,125,248 A 9/2000 Moser
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,532,351 B2 3/2003 Richards et al.
6,537,910 B1 3/2003 Burke et al.
6,550,762 B2 4/2003 Stoll
6,554,276 B2 4/2003 Jackson et al.
6,577,925 B1 6/2003 Fromherz
6,584,290 B2 6/2003 Kurz et al.
6,606,165 B1 8/2003 Barry et al.
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,650,847 B2 11/2003 Guy et al.
6,809,831 B1 * 10/2004 Minari ..... 358/1.15
6,810,218 B1 10/2004 Wong et al.
6,819,906 B1 11/2004 Herrmann et al.
6,888,644 B2 5/2005 Barry et al.
6,903,837 B1 6/2005 Moreau et al.
6,914,696 B1 7/2005 Kojima et al.
6,925,283 B1 8/2005 Mandel et al.
6,930,795 B1 8/2005 Motamed et al.
6,935,713 B2 8/2005 Phillips
7,123,848 B2 * 10/2006 Clement et al. ..... 399/24
7,298,501 B2 * 11/2007 Christodoulou et al. .... 358/1.12
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2006/0269310 A1 * 11/2006 German et al. ..... 399/82

FOREIGN PATENT DOCUMENTS

JP 2002288389 A * 10/2002
JP 2004206588 A * 7/2004

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.,
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.

* cited by examiner

PRINTING SYSTEM WITH BALANCED CONSUMABLE USAGE

BACKGROUND

The exemplary embodiment relates to the printing arts. It finds particular application in connection with optimization of consumable usage, such as the usage of toners in a printing system comprising multiple marking engines, and will be described with particular reference thereto. However, it will be appreciated that the exemplary embodiment finds application in other printing systems.

Electronic image forming systems, such as printing/copying systems, typically employ an input terminal which receives images in digital form and conversion electronics for converting the image to image signals or pixels. The printing system may include a scanner for scanning image-bearing documents or be connected to a computer network which supplies the digital images. The image signals are stored and are read out successively to a marking engine for formation of the images and transfer of the images to a print medium, such as sheets of paper.

In typical xerographic (electrophotographic) printing systems, such as copy machines and laser beam printers, the marking engine includes a photoconductive insulating member, which is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises toner particles adhering triboelectrically to carrier granules, which is often referred to simply as toner. The developed image is subsequently transferred to the paper. The fusing of the toner image onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the paper to create a multi-layered toner image on the paper. The multi-layered toner image is then permanently affixed to the paper in the fusing process.

Printing systems have been developed which employ multiple marking engines for providing higher print outputs by distributing a print job among the marking engines. These systems may include several black, process (or full) color, and/or custom color (single color or monochrome) marking engines for printing of selected pages within a print job. Each marking engine has a number of components which can be regarded as consumables, since they are designed to be consumed or worn out and replaced at intervals during the normal lifetime of the printing system. Consumables for xerographic marking engines typically include toner cartridges, photoreceptor belts, and the like. Ink jet printers often have ink cartridges containing ink in liquid or solid form. In a color marking engine for a xerographic process, for example, there may be four toner cartridges, one for each of the cyan, magenta, yellow, and black separations of the image. As the number of marking engines in a printing system increases, the number of times any one of the toner cartridges needs to be replaced in a given time period increases. For example, in a printing system with four process color marking engines, there may be sixteen toner cartridges. Even where each marking engine prints an approximately equal number of pages, differences in the content of the pages and individual attributes of the marking engines can result in unequal consumption of the marking materials. For example, a page with a large proportion of solid black or other color will consume more toner than a page which is light grey or has only a small area of coverage. Since the cartridges tend to run out at different times, it is difficult for the operator to set up a replacement schedule for simultaneous replacement of cartridges or other consumable items without resulting in considerable wastage of the consumables. An alternative is to allow one or more of the cartridges to run out, with print jobs being reallocated to marking engines which have residual marking media. However, this can lead to a reduction in productivity of the system until the empty cartridges are replaced.

CROSS REFERENCE TO RELATED PATENTS AND APPLICATIONS

The following applications, the disclosures of each being totally incorporated herein by reference are mentioned:

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,458, filed Aug. 23,2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/081,473, filed Mar. 16, 2005, entitled "PRINTING SYSTEM," by Steven R. Moore;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. C-I-P application Ser. No. 11/137,273, filed May 25, 2005, entitled "PRINTING SYSTEM," by David G. Anderson et al.;

U.S. application Ser. No. 11/137,251, filed May 25, 2005, entitled "SCHEDULING SYSTEM," by Robert M. Lofthus et al.;

U.S. application Ser. No. 11/215,791, filed Aug. 30, 2005, entitled "CONSUMABLE SELECTION IN A PRINTING SYSTEM," by Eric. S. Hamby, et al.

INCORPORATION BY REFERENCE

U.S. Pat. No. 5,867,198 for "METHOD FOR ESTIMATION OF TONER USAGE IN DIGITAL XEROGRAPHIC COPIERS AND PRINTERS," by Gwaltney, et al., which is incorporated herein in its entirety by reference, discloses methods for estimating toner usage based on the number of pixels developed, the mass of toner developed, and the area of each pixel.

U.S. Pat. No. 5,636,032 for "SYSTEM AND METHOD FOR INFORMING A USER OF A MARKING MATERIAL STATUS IN A PRINTING ENVIRONMENT," by Springett, which is incorporated herein in its entirety by reference, discloses a system and method for informing a user about characteristics of a marking material cartridge in a printing system. The system calculates a number of pixels being rendered in a present job and calculates an amount of marking material used to render the present job. The system also calculates a total area coverage to date for the marking material cartridge. From this information an expected number of pages that the marking material cartridge can render is determined and displayed. The system determines a date when marking material in the marking material cartridge will be depleted and displays the date.

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages): U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al., U.S. application Ser. No. 10/924,459, filed Aug. 23,2004, entitled "PARALLEL PRINTING ARCHITECTURE USING IMAGE MARKING ENGINE MODULES," by Mandel, et al., U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,489,969 to Soler, et al.; U.S. Pat. No. 6,606,165 and 6,888,644 to Barry, et al., a 1991 "Xerox Disclosure Journal" publication of November-December 1991, Vol. 16, No. 6, pp. 381-383 by Paul F. Morgan; and a Xerox Aug. 31, 2001 "TAX" publication product announcement entitled "Cluster Printing Solution Announced."

BRIEF DESCRIPTION

Aspects of the exemplary embodiment relate to a printing system, a storage medium, and to a method.

In one aspect, a printing system includes a plurality of marking engines, each of the marking engines selectively receiving at least one replacement module. The replacement module includes a consumable which is consumed during rendering of images by the marking engine. A scheduling system assigns images to the marking engines for rendering on a print medium. The scheduling system has a mode of operation in which images are selectively assigned to the marking engines to balance usage of the consumable by the marking engines.

In another aspect, a storage medium comprising information for scheduling print jobs for printing by a plurality of associated marking engines. The storage medium includes information that for each of a plurality of images to be rendered stores a toner level for each of the associated marking engines and assigns images to a selected one of the plurality of marking engines based on the toner levels, to balance usage of the consumable.

In another aspect, a method includes, for each of a plurality of marking engines, installing a replaceable module in the marking engine. Each replaceable module includes a consumable which is consumed during rendering of images by the marking engine. Images are selectively assigned to the marking engines for rendering the images on print media, whereby consumption of the consumable is balanced among the marking engines.

In another aspect, a printing system includes a plurality of marking engines. Each of the marking engines is configured for rendering images by applying a marking material to a print medium. A replaceable marking material cartridge is associated with each of the marking engines which supplies the marking material to the marking engine. A level of the marking material diminishing as the marking material is applied to the print medium. A processing component tracks the levels of the marking materials for each of the marking engines. A scheduling system in communication with the processing component identifies marking engines which are available for rendering images and assigns the images to be rendered among the marking engines so as to reduce a variation between the levels of the marking material.

DETAILED DESCRIPTION

Figure 1:
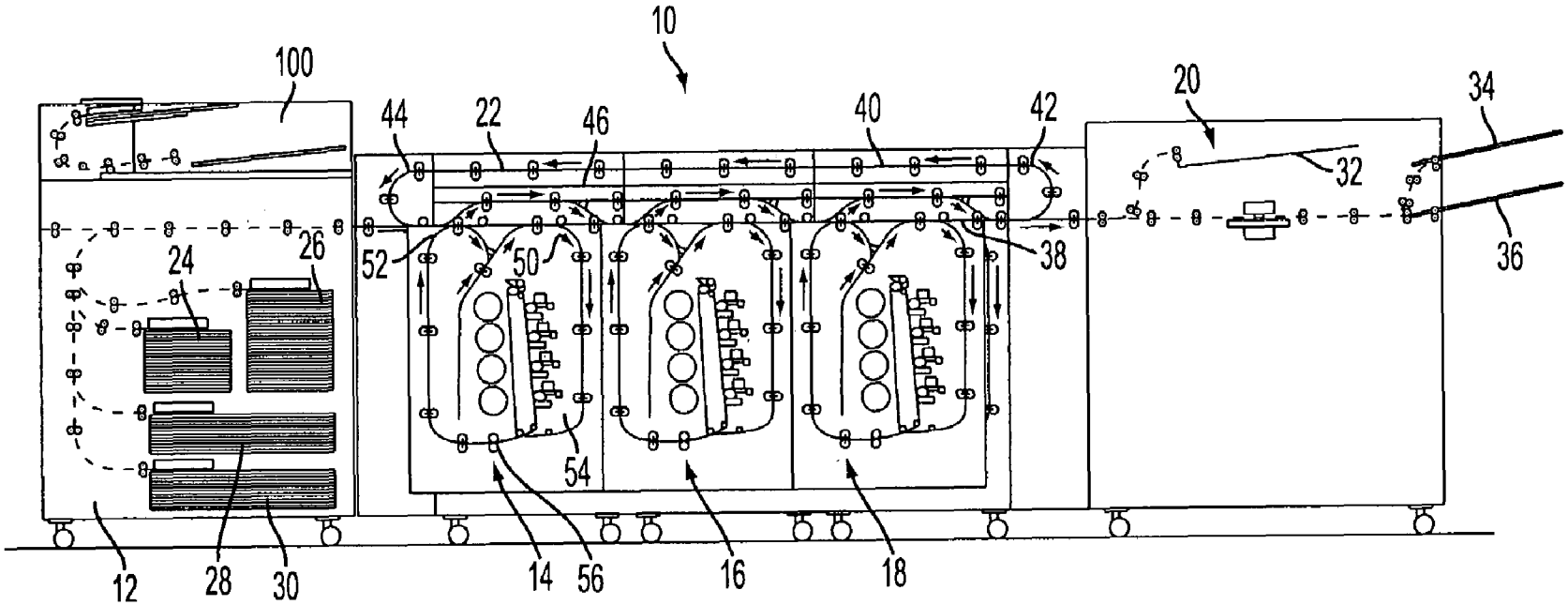
FIG. 1 is a schematic side view of a printing system in accordance with one aspect of the exemplary embodiment.

Aspects of the exemplary embodiment relate to a printing system which comprises a plurality of marking engines, each comprising at least one replacement module comprising a consumable. The printing system includes a scheduling system which routes individual images or entire print jobs to marking engines having similar printing capabilities based on a determination of the consumption of one or more of the consumables, such as marking materials, by each of the marking engines. In this way, variations in consumption of the consumables by the marking engines can be reduced. An operator of the printing system is thus able to replace several of the replacement modules from different marking engines at the same time, while minimizing wastage of consumables.

The term "marking engine" is used herein generally to refer to a device for applying an image to print media. Print media generally refers to a usually flimsy physical sheet of paper, plastic, or other suitable physical print media substrate for images, whether precut or web fed. A "printing system" can be a digital copier or printer, bookmaking machine, facsimile machine, multi-function machine, or the like and can include several marking engines, as well as other processing components, such as paper feeders, finishers, and the like. "Print jobs" or "documents" generally include a plurality of digital "pages" to be rendered as one or more copies on a set of associated sheets of print media, each page, when rendered, constituting the front or back side of a sheet. The pages of a print job may arrive from a common source and, when rendered, be assembled at a common output destination.

While particular reference is made herein to marking materials as consumables and marking material cartridges as replacement modules, it is to be appreciated that similar principles may be applied to the optimization of replacement schedules for other consumables, such as photoreceptors, fuser rolls, fuser cleaning webs, cleaner blades, cleaner brushes, charge scorotron/corotrons, transfer corotrons, bias transfer rolls, bias charge rolls, intermediate transfer belts, intermediate transfer belt cleaners, feed rollers, registration rollers, stripper fingers, developer housings, NOHAD (noise, ozone, heat, and dirt) filters, preclean scorotron/corotrons, and the like.

The printing system generally includes two or more marking engines of the same print modality, such as black only (K) process color (P), or custom color (C) marking engines and which can be used interchangeably for at least some of the print jobs or portions thereof that are handled by the printing system. The printing system may be configured for parallel printing such that portions of a print job may be distributed among two or more marking engines of the same print modality and then assembled as a single document or such that several print jobs may be distributed among the marking engines whereby two or more print jobs may be printed contemporaneously. Additionally or alternatively, the printing system may be configured for printing opposite sides of a sheet on different marking engines (tandem duplex printing).

The printing system may include marking engines of two or more print modalities, such as process color and black marking engines. Each of the marking engines of the same print modality may be nominally identical or can have differences, such as in the output (prints per minute), chemical composition of the marking materials used, capacity of the marking material cartridges, and the like.

In one aspect, replacement modules, such as replacement marking material cartridges, for two or more marking engines are interchangeable. This reduces the number of different replacement modules which an operator need to stock.

The printing system tracks usage of the consumables, either indirectly or directly. Specifically, the printing system stores a measure of one or more consumable levels for each of the marking engines and adjusts the consumable levels as the consumable is consumed. Thus, the consumable level is higher for a consumable which has a longer expected life than another.

In the case of a toner, for example, the consumable level can be a direct or indirect measure of the amount of residual toner in the cartridge, a percentage of initial toner remaining, an estimate of the number of pages which can be printed with the residual toner, or other measure of toner usage. In the case of a photoreceptor belt, the belt may be assumed to have a fixed lifetime, such as a predefined number of belt revolutions, and the consumable level can be expressed in terms of number of revolutions of the belt remaining, number of copies which can be made, or the like.

For marking materials, such as toners or ink, a determination of the consumption of the consumable can be made directly, for example, by sensing the amount of marking material remaining in a replaceable marking material cartridge or its flow rate, or indirectly, from information on the images to be printed. In one aspect, pixel count information, on the documents to be printed (print jobs), which is typically received by the printing system in the form of a bitmap, is stored by the printing system. The information can be used to determine the consumable usage by utilizing assumptions on mass developed (the amount of marking material of each color separation used in rendering the pixel) and optionally also any resulting transfer inefficiencies. The information stored also includes the marking engine used to print the document, or portion thereof, from which the consumption of one or more of the marking materials for each marking engine can be determined.

In addition to tracking consumable usage, the printing system also balances consumable usage. In one aspect of the exemplary embodiment, the object of balancing consumable usage is to reduce the rate of operator interventions, i.e., the number of occasions in any given time period that the operator has to perform consumable replacement operations. If several replacement modules can be replaced during a single intervention, this decreases the number of interventions and, concomitantly, the time between operator interventions. However, replacement of a consumable before it reaches the end of its useful life is undesirable due to wastage of the consumable. Thus, the balancing is performed such that a plurality of consumables reach the end of their useful life at approximately the same time and are thus replaced with a minimum of wastage.

For example, in the case of balancing toner cartridge replacement, the scheduling system makes use of the stored information on toner level to schedule a print job or group of print jobs to balance consumption of the marking materials by the various making engines so that the cartridges of a particular color separation (e.g., cyan, magenta, yellow, or black) run out at approximately the same time. In this way, all of the cartridges of the same color separation can be replaced at the same time, without appreciable wastage. The scheduling system need not balance consumable usage in every print job or even on a daily basis, but may take advantages of opportunities where there is a choice of marking engines for a particular print job to balance out the consumable usage. The scheduling system may flag particular jobs as being particularly suited to equilibrating the printing system. These jobs may include print jobs where the pages are predominantly of a particular color separation or pages of print jobs which are determined to be associated with a higher consumable usage, e.g., a higher developed mass for one or more color separations.

The scheduling of print jobs or pages may include scheduling print jobs for printing on a marking engine which has a larger marking material level, such as a larger quantity of marking material remaining. In this way, any variation between the expected replacement times of the toner cartridges is reduced.

In some systems, where several marking engines are of the same configuration, the marking material cartridges of a particular color may be interchangeable and initially hold the same amount of marking material. Thus, the balancing may include scheduling a print job to make use of a marking engine which has a larger amount of toner remaining so that the cartridges can be replaced at the same time interval. In other cases, for example, where the toner cartridges are of a substantially different size, it may be advantageous to replace one of the cartridges at other intervals, such as at an interval which is twice that of a smaller cartridge. In such cases, the balancing of usage reduces operator interventions by achieving a consumption of approximately half the toner in the larger container in the time taken for the smaller container to be depleted.

In general, the scheduling of balancing print jobs is performed without influencing the productivity of the system. Thus, for example, where the number of print jobs awaiting printing exceeds the capacity of the printing system and balancing is not possible without resulting in a reduction in productivity, the scheduling system may allow the consumable levels to go out of balance in order that maximum productivity is maintained. Once an opportunity for rebalancing without affecting productivity is available, the scheduling system returns to balancing consumable usage.

While the scheduling system may balance usage of more than one type of consumable, such as both toner cartridges and photoreceptor belts, it is generally advantageous for the printing system to place a priority on balancing consumption of the consumable which has the shortest useful lifetime. Typically, the marking material cartridges are the most frequently replaced and thus the printing system can generally reduce interventions most effectively by prioritizing the balancing of marking materials. In some cases, the consumption of one of the other consumables may be speeded up such that its replacement coincides with an intervention required for marking material cartridge replacement. For example, the usage of a particular photoreceptor belt may be increased so that it will end its useful life at approximately the same time as a set of marking material cartridges.

Additionally, the scheduling system may not be able to balance simultaneously the usage of all the toner colors. Thus, the printing system may make a determination as to which of the toner colors is expected to be depleted first. This determination may be based on the history of toner usage and the respective toner levels. The scheduling system then places a priority on balancing the toner color which is determined to be closest to depletion.

The marking material cartridge for the black toner is typically of larger capacity than those of the primary colors (cyan, magenta, and yellow) since black marking material tends to be used more frequently than the primary colors. Consequently, usage of black marking material is less likely to vary between marking engines than usage of the primary colors. Thus, in one aspect, the printing system may consider one or more of the primary colors in balancing toner usage and ignore usage of the black toner.

In another aspect, two or more consumables are incorporated into a single replacement module. For example, cyan, magenta, and yellow marking materials are housed in a single replacement cartridge, which is replaced as a unit. Or, a photoreceptor may be bundled with a belt cleaner. In such instances, the scheduling system may balance consumable usage among the marking engines such that each of the consumables in a single cartridge are depleted at approximately the same time.

In another aspect, the scheduling system enters a balancing mode only when the consumable to be balanced is reaching depletion. For example, balancing may commence when less than 50% or less than 10% of the toner remains in the cartridge of one of the marking engines.

With reference to FIG. 1, an exemplary printing system 10 in which the scheduling system and scheduling methods disclosed herein may be employed is shown. The printing system may be a printer, copier, or a multifunction device having both printing and copying capabilities. The illustrated printing system 10 is a modular system and includes a plurality of processing units, such as a print media source 12, a plurality of marking engines 14, 16, 18, and an output destination 20, such as a finisher. The processing units 12, 14, 16, 18, and 20 are all interconnected by a print media conveyor 22. In some embodiments, one or more of the processing units 12, 14, 16, 18, 20 are removable processing units. For example, the functional portion of a processing unit may be removed, leaving only the external housing or mounting fixture through which the print media conveyor 22 passes. In this manner, for example, the functional portion can be removed for repair, or can be replaced to effectuate an upgrade or modification of the printing system 10.

The printing system 10 executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 10 are determined by the capabilities of the paper source 12, marking engines 14,16, 18, and finisher 20 of the printing system 10. These capabilities may increase over time due to addition of new processing units or upgrading of existing processing units. The capabilities may also decrease over time due to failure or removal of one or more processing units.

While three marking engines 14, 16, 18 are illustrated, the number of marking engines can be any number, such as two, three, four, five, six, or more. The three illustrated marking engines 14, 16, 18 are all multi-color (process color, P) marking engines. However, one or more of the marking engines 14, 16, 18 may be a monochrome engine, such as a black (K) marking engine or a custom color (C) marking engine.

The illustrated marking engines 14, 16, 18 employ xerographic printing technology, in which an electrostatic image is formed and coated with a toner material, and then transferred and fused to paper or another print medium by application of heat and/or pressure. However, marking engines employing other printing technologies can be provided as processing units, such as marking engines employing ink jet transfer, thermal impact printing, or the like.

The illustrated print media source 12 is a high capacity feeder which includes print media sources 24, 26, 28, 30, such as trays, which are connected with the print media conveyor 22 to provide selected types of print media to all of the marking engines. While four print media sources are illustrated, the number of print media sources can be one, two, three, four, five, or more. In other embodiments, one or more of the marking engines may include its own dedicated print media source. Each of the print media sources 24, 26, 28, 30 can store sheets of the same type of print medium, or can store different types of print media. The print media can be substantially any type of medium upon which one or more of the marking engines 12, 14, 16 can print, such as: high quality bond paper, lower quality "copy" paper, overhead transparency sheets, high gloss paper, heavy weight paper and card, paper of different sizes, and the like.

The print media conveyor 22 is controllable to acquire sheets of a selected print medium from the print media sources 24, 26, 28, 30, transfer each acquired sheet to one or more of the installed marking engines 14,16,18 to perform selected marking tasks, and then transfer each sheet to the finisher 20 to perform finishing tasks. The finisher 20 receives the pages of a print job in output order and includes one or more print media output destinations, 32, 34, 36, herein illustrated by trays. While three output destinations 32, 34, 36 are illustrated, the printing system 10 may include one, two, three, four, or more print media output destinations.

The print media conveyor 22 includes a plurality of paper paths and associated drive elements, such as rollers, spherical balls, or air jets, which convey the print media along the paths and may include diverters, inverters, interposers, and the like, as known in the art. The paths may be in the form of loops which allow print media from one marking engine to be delivered to another marking engine for duplex printing (two sided printing) or overprinting (printing on the same side of the sheet). In the illustrated printing system 10, print media which has been printed by one marking engine can be routed to any other marking engine. Additionally, bypass pathways allow any one or more of the marking engines to be bypassed. In other configurations (not shown) the routing may be more limited. In the exemplary embodiment, main downstream and upstream highways 38, 40, respectively, are connected at ends thereof by junctions 42, 44, while a second, optional downstream highway 46 is accessible from the first downstream highway 38 for high speed bypassing one or more of the marking engines 14, 16, 18 and/or advancing sheets out of order. Branch pathways 50, 52 connect the main downstream highway 38 with respective ones of the marking engines. While the illustrated marking engines are aligned in a linear arrangement, it is also contemplated that they may be stacked in a two or three dimensional configuration.

In the illustrated embodiment, at least one paper source 24, 26, 28, 30 is connected by the conveyor 22 with at least two marking engines of the same print modality, such as process color marking engines 14, 16, and 18. A print job or a plurality of print jobs employing the paper can be selectively distributed among two or more of the marking engines 14, 16, 18 for parallel printing (two or more marking engines each performing part of a print job) or to two or more marking engines in series for duplex printing or overprinting.

The printing system 10 is an illustrative example. In general, any number of print media sources, media handlers, marking engines, collators, finishers or other processing units can be connected together by a suitable print media conveyor configuration. In some embodiments, the printing system may be a cluster of networked or otherwise logically interconnected printers each having its own associated print media source(s) and finishing components. In such embodiments, the marking engines 14, 16, 18, need not be linked by a common conveyor system.

Figure 2:
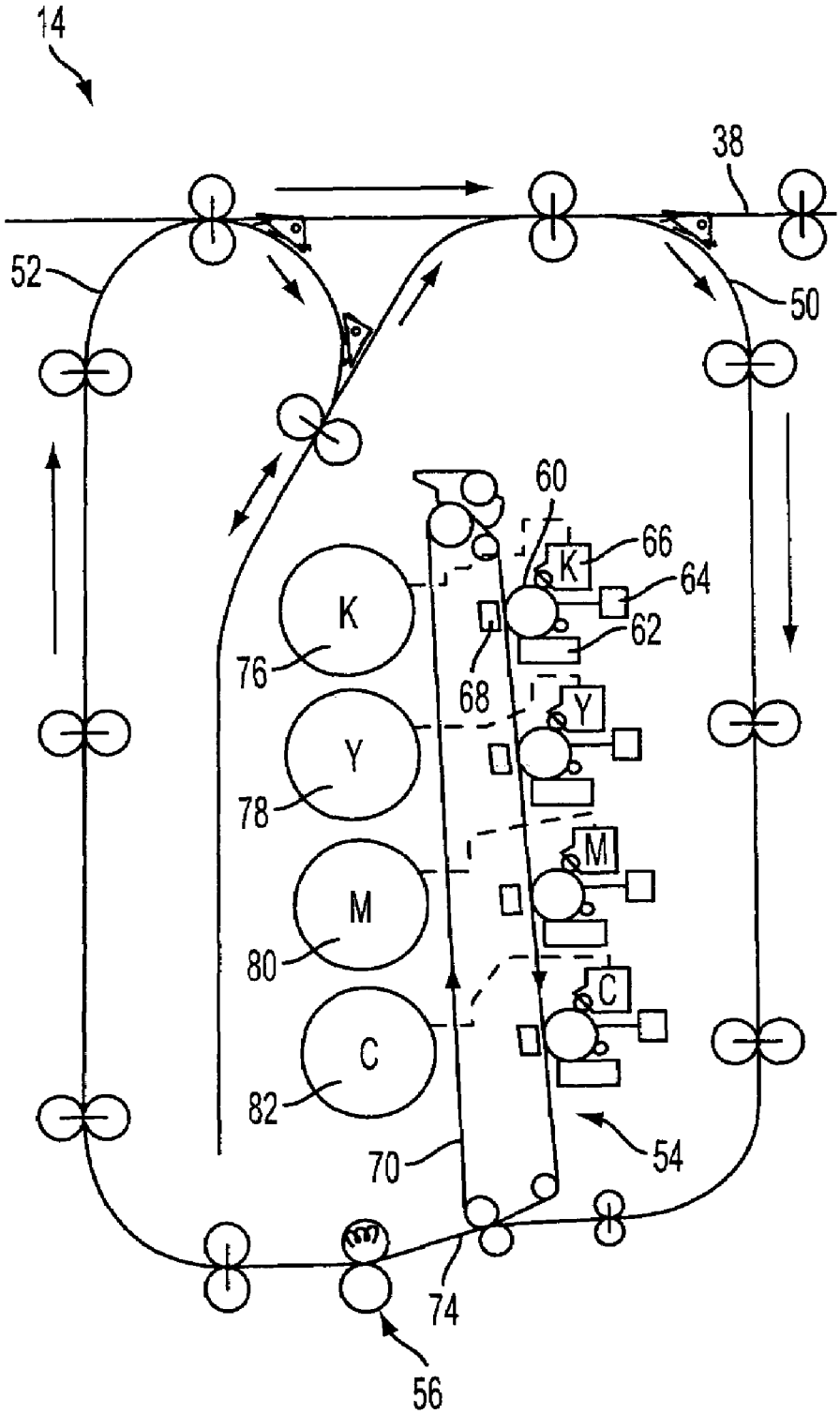
FIG. 2 is a schematic view of one of the marking engines of the printing system of FIG. 1.

FIG. 2 illustrates one of the marking engines 14, by way of example. Marking engines 16 and 18 may be similarly configured. The marking engines each include an image applying component 54, for applying an image to the print media, and a fuser 56, for fixing the applied image to the print media by application of at least one of heat and pressure. Marking engines 16 and 18 may be similarly configured. In the case of a xerographic marking engine, for example, the marking engine includes various xerographic subsystems for forming an image, transferring the image to a sheet of paper, and fusing the image to attach the image more permanently to the print media. The marking engine of a xerographic system typically includes a charge retentive surface, such as a rotating photoreceptor 60 in the form of a belt or drum. The images are created on a surface of the photoreceptor. Disposed at various points around the circumference of the photoreceptor 60 are the xerographic subsystems, which include a charging station 62 for one or more of the colors to be applied, such as a charging corotron, an exposure station 64, which forms a latent image on the photoreceptor, such as a Raster Output Scanner (ROS) or LED bar, a developer unit 66, associated with each charging station 62 for developing the latent image formed on the surface of the photoreceptor by applying a toner to obtain a toner image, a transfer unit 68, such as a transfer corotron, transfers the toner image thus formed to the surface of a print media substrate, such as a sheet of paper, or to an intermediate transfer belt. In the illustrated embodiment, each of four toners cyan, magenta, yellow, and black (CMYK) is applied to a separate photoreceptor 60, and the resulting image transferred to an intermediate transfer belt 70. The composite image is transferred from the belt 70 to a passing sheet at transfer point 74 and carried to the fuser 56.

In an alternative embodiment (not shown) the charging station 62, exposure station 64, and developer unit 66 for each of the four toners are spaced around the same photoreceptor. In this embodiment, no intermediate transfer belt is required and the transfer point 74 can be the point at which the toner is transferred from the photoreceptor to the print media. A marking engine of this type is disclosed, for example, in above-mentioned copending application Ser. No. 11/137,251, incorporated herein by reference. In any particular embodiment of an electrophotographic marking engine, there may be variations on this general outline, such as additional corotrons, cleaning devices, and the like.

Each of the developer housings 66 is supplied with toner from a separate replaceable toner cartridge 76, 78, 80, 82, for K, Y, M and C respectively. In a black marking engine, there need only be one black replaceable cartridge. For example, each cartridge 76, 78, 80, 82 may make a screw fit or other connection with a port (not shown) on the respective developer housing 66 whereby toner is delivered from the cartridge into the developer housing, as shown, for example, in U.S. Pat. No. 6,650,847 by Guy, et al., which is incorporated herein by reference in its entirety.

Figure 3:
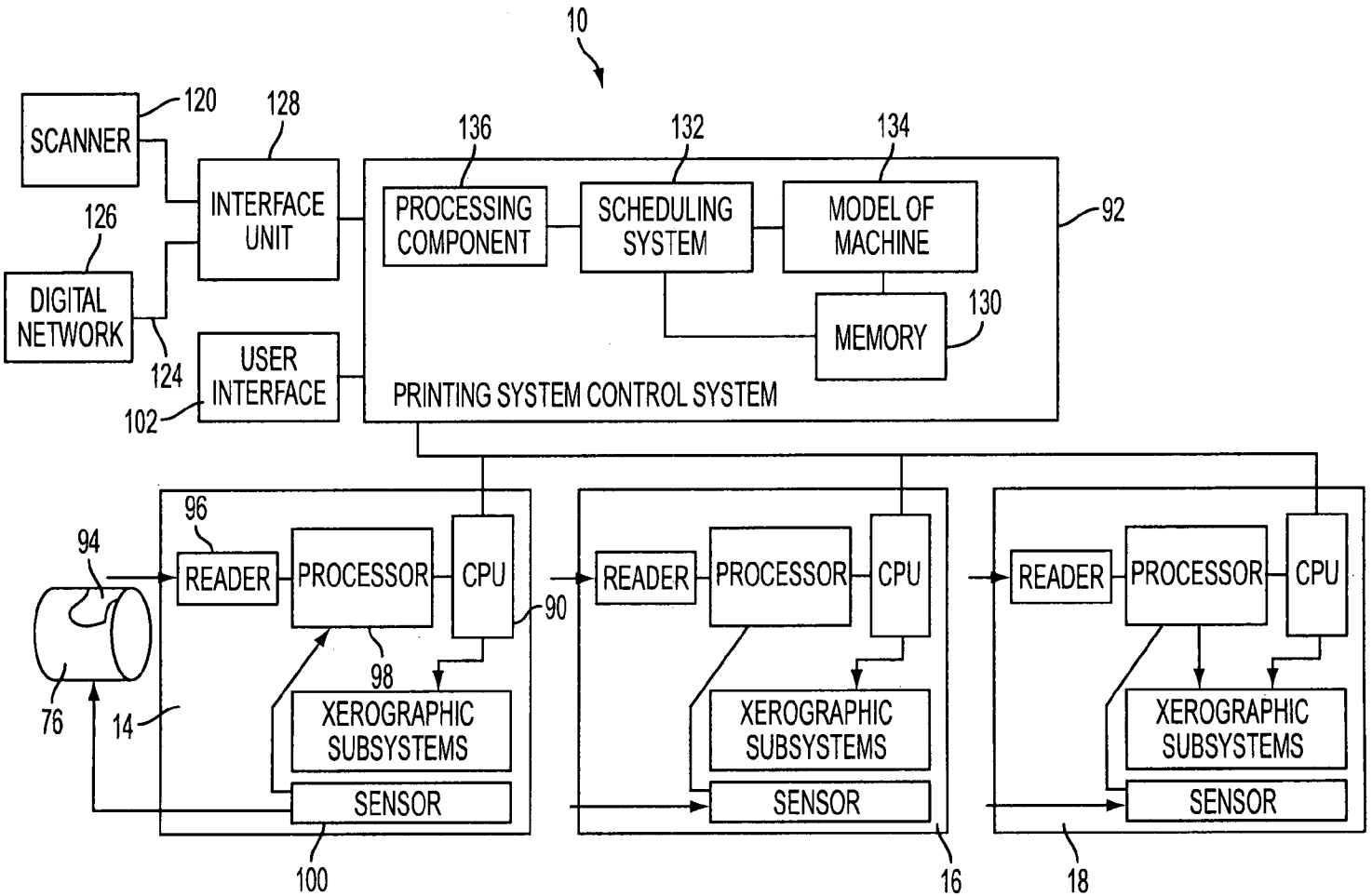
FIG. 3 is a block diagram of the printing system of FIG. 1.

With reference now to FIG. 3, the xerographic subsystems 62, 64, 66, 68 are controlled by a processing component, which may be located in the marking engine and/or elsewhere in the printing system 10. In the illustrated embodiment, the processing component is distributed over the printing system and includes a marking engine controller 90 such as a CPU, associated with each marking engine 14, 16, 18, which includes actuators for controlling each of the subsystems, and an overall control system 92, which communicates with the individual marking engine CPUs 90 as described in greater detail below. The marking engine controller 90 is linked to the system controller 92 and may be also linked to other known components, such as a memory, a marking cartridge platform, a marking driver, a function switch, a self-diagnostic unit, all of which can be interconnected by a data/control bus. Each marking engine 14, 16, 18 may have its own marking engine controller 90, as shown in FIG. 3.

Certain modules in the printing system 10 are designed to be replaceable during the lifetime of the printing system. For example, the marking material cartridges are generally designed to be replaceable by the operator of the printing system 10. During use, the printing system 10 consumes the marking material contained in the cartridges 76, 78, 80, 82 and the depleted or empty cartridges are then replaced. Other consumable modules may also be replaceable, either by an operator or by a skilled technician. Examples of other printing system replaceable modules include the photoreceptor belt or drum 60, the transfer corotron 68, and the fuser 56 (or individual components of the fusing subsystem). In addition to the applicability to different replacement modules of an electrophotographic printing system, the principles are also applicable to replacement modules of other types of printing system. For example, in an ink jet printer, the replacement module may be a container holding ink, either solid ink for a phase change ink jet printing apparatus or liquid ink for a liquid ink printing apparatus. Replacement modules for an ink jet printer may also include the printhead, a transfer drum, and maintenance elements for the printhead and/or drum.

The illustrated cartridge 76 includes an identifier 94, which allows the printing system control system 92 to identify when the cartridge is being replaced. The identifier 94 may also provide information on the marking material contained in the cartridge, such as the amount of marking material, its chemical composition, and or other information which may be useful to the making engine in determining toner throughput or other operating parameters of the marking engine. The identifier may be attached to, printed on, or otherwise associated with the cartridge 76. Specifically, the identifier 94 is read by a reader 96 which communicates information on the cartridge 76 to a processing component 98 which is in communication with the printing system control system 92, either directly, or indirectly, as shown, via the marking engine CPU 90. The identifier 94 may be mounted to an exterior wall of the container, or other suitable locations accessible to the reader. The identifier 94 may be in the form of a tag, such as a customer replaceable unit monitor (CRUM), a radiofrequency tag, or a UPC code, or may include a color code, detectable chemical marker, a combination thereof, or the like. In the case of a CRUM as an identifier, the CRUM or CRUMs may contain memory that stores information pertaining to the replacement module 76, as described more fully in U.S. Pat. No. 6,016,409 to Beard, et al., which is incorporated herein in its entirety by reference. Exemplary CRUMs are described in U.S. Pat. No. 6,532,351, to Richards, et al., and U.S. Pat. No. 6,584,290 to Kurz, et al., incorporated herein by reference in their entireties. The reader 96 may comprise one or more of a CRUM reader, bar code reader, radiofrequency source and/or detector, colorimetric sensor, ultraviolet or infrared sensor, chemical sensor, other reader which is compatible with the identifier 94. Each of the toner cartridges 76, 78, 80, 82 to be used in the printing system can be associated with its own identifier 94 and optionally its own reader 96, although it is also contemplated that a single reader may read the identifiers on all cartridges.

The printing control system 92 can determine when a particular cartridge has been replaced, for example, from unique information on the identifier 94 or through communication with the processor 98, which identifies the cartridge by some other means, such as through the actuation of a switch (not shown) when a cartridge 76, 78, 80, 82 is inserted and/or removed. Alternatively or additionally, an operator interacts with a user interface 102 (FIG. 2), such as a keyboard, touch screen, or the like, whereby the control system 92 is notified that a particular one or more of the cartridges 76, 78, 80, 82 have been replaced.

The printing system 10 may determine toner usage from information on the images to be printed. For example, the determination of toner usage may be based on the number of pixels developed, the mass of toner developed, and the area of each pixel, as described, for example, in U.S. Pat. Nos. 5,867,198, 6,810,218, and 5,636,032, incorporated herein by reference, and discussed in further detail below. Alternatively, a sensor 100 may be positioned to detect the amount of toner remaining in the cartridge 76, and may include, for example, an optical sensor which views the level of remaining toner in the cartridge, a sensor which detects the weight of the cartridge 76, a diaphragm sensor which detects the presence of toner through its damping effect on the diaphragm, a flow meter which determines the flow of toner from the cartridge, or other suitable sensing device.

With continued reference to FIG. 3, an image input device supplies the printing system 10 with images to be printed. The image input device can comprise a built-in optical scanner 120, which can be used to scan a document such as book pages, a stack of printed pages, or the like, to create a digital image of the scanned document that is reproduced by printing operations performed by the printing system 10. Alternatively, a print job can be electronically delivered to the printing system 10 via a wired or wireless connection 124 to a digital network 126 that interconnects, for example, personal computers (not shown) or other digital devices. The printing system includes an interface unit 128, in communication with the control system 92, which converts the digital images and associated instructions into a form which can be utilized by the printing system 10. Each page of an incoming print job is converted by the interface unit 128, or other suitable processing component, to a bitmap in a raster image processing step. This information is fed to the printing system control system 92 or other processing component of the printing system, and may be stored as an image bitmap in a memory device 130.

The control system 92 includes a scheduling system 132 which schedules the order of printing of incoming print jobs and identifies a marking engine or marking engines 14, 16, 18 for printing each of the pages of the print jobs. The scheduling system 132 accesses a model of the machine 134 to obtain information on the printing system for scheduling jobs. The model of the machine 134 stores information on the capabilities of each of the marking engines of other components of the printing system. The scheduling system communicates with the marking engines 14, 16, 18 and other components 12, 20, 22 of the printing system 10 to coordinate the printing of the print job, including the transportation of the print media to the marking engines and the collation and assembly of print jobs output by the finisher 20 according to a scheduled itinerary. The model of the machine 134 is periodically updated with information on the current states of the marking engines 14, 16, 18 and the installed toner cartridges installed by querying the marking engine CPUs 90.

A processing component 136 tracks the consumable levels for each consumable of each marking engine 14, 16, 18 (twelve toner levels in the case of the illustrated printing system) and stores the information in memory 130. Each toner cartridge 76, 78, 80, 82 may come pre-filled with a specified (known constant) initial amount of toner. That initial amount may be stored in memory 130. As each page is assigned to one of the marking engines 14, 16, 18, 20, the calculated toner amount to be used is subtracted from the remaining balance of toner for the corresponding cartridge, and the new toner amount balance value is saved. The user can be advised as to the amount of toner remaining in each cartridge by a display associated with the user interface 102.

For each page to be printed, the processing component accesses the memory 130 where the bitmap for the page is stored. The processing component 136 determines the amount of toner of each color separation to be used from the bitmap, for example, by tracking the pixel count, developed mass, and pixel area as described, for example, in abovementioned U.S. Pat. Nos. 5,867,198, 6,810,218, and 5,636,032. Since the developed mass may vary according to the type of paper used (e.g., its weight or surface texture) these and other factors may be incorporated into the determination of the toner consumption. Once the destination of the print job is determined, the processing component 136 adjusts the determined toner levels of the marking materials for each of the cartridges in the marking engine(s) to be used for printing the page by deducting the determined toner consumption from the previous toner level. Alternatively, the processing component 136 receives a direct measure of the actual toner in the cartridges from the marking engines.

The residual toner levels may be stored in the memory 130 in any suitable form, such as a determined or actual amount of available toner in the cartridges 76, 78, 80, 82 of each marking engine 14, 16, 18, an estimate of the number of pages which can be printed before the cartridge is depleted, based on historical usage/page, or some other measure of cartridge life expectancy.

In assigning the images to the marking engines for printing, the scheduling system 132 takes into account the toner levels. For example, when the scheduling system 132 determines that two or more of the marking engines are available for printing a print job or pages thereof, the scheduling system 132, through communication with the processing component 136 selects the marking engine with the highest toner level for one or more of the toners to be used to print the print job or selected pages. In this way, the scheduling system can balance the usage of toner so that no one marking engine is overly depleted.

It will be appreciated that for color printers having more than one toner cartridge, each cartridge may have a different toner level and thus the scheduling system 132 may not be able to balance toner usage for all cartridges in a single print job but may obtain a balance in toner usage over several print jobs. Additionally, some jobs may arrive with specific instructions which limit or override the scheduling system's ability to distribute the jobs according to toner usage. For example, the print job information or the operator may specify a high consistency in color or gloss, which the scheduling system 132 may be programmed to satisfy by printing all the pages on the same marking engine. Over the course of the lifetime of the consumable, however, the scheduling system 132 can balance usage of the consumable across the marking engines. In this way, when one of the toner cartridges, such as the cyan cartridge, is depleted, the operator can replace all the cyan cartridges in the printing system, with the assurance that little or no toner is being wasted.

In one aspect, the processing component 136 identifies which toner cartridge is closest to depletion, for example, based on residual toner levels, e.g., the estimated number of pages before depletion. For example, the processing component 136 may identify that the magenta cartridge 80 of marking engine 14 can print an estimated 1000 pages before depletion, with all other cartridges having a higher page estimate. For example, marking engine 16 may have an estimate of 1050 pages for its magenta cartridge and marking engine 18 an estimate of 1060 pages. The scheduling system 132 places a priority on balancing the usage of the three magenta cartridges in the printing system so that the variation in the toner levels and/or estimated time or number of pages to depletion is reduced. For example, the scheduling system directs more pages (or more pages having a relatively high magenta content) to marking engines 16 and 18 than it does to marking engine 14. After about fifty pages have been printed, the new toner level estimates may be, for example, 990, 1030, 1035, for the marking engines 14, 16, and 18. As further pages are printed, the variation may be further reduced. However, if for example, one of the cyan cartridges 82 has an estimated number of pages to depletion of 980, which is then lower than the 990 of the magenta cartridge of marking engine 14, the scheduling system 132 may shift focus to reducing the variation in toner levels of the three magenta cartridges.

In another aspect, the scheduling system 132 takes one of the colors as representative of the others and balances usage of only the representative color.

Figure 4:
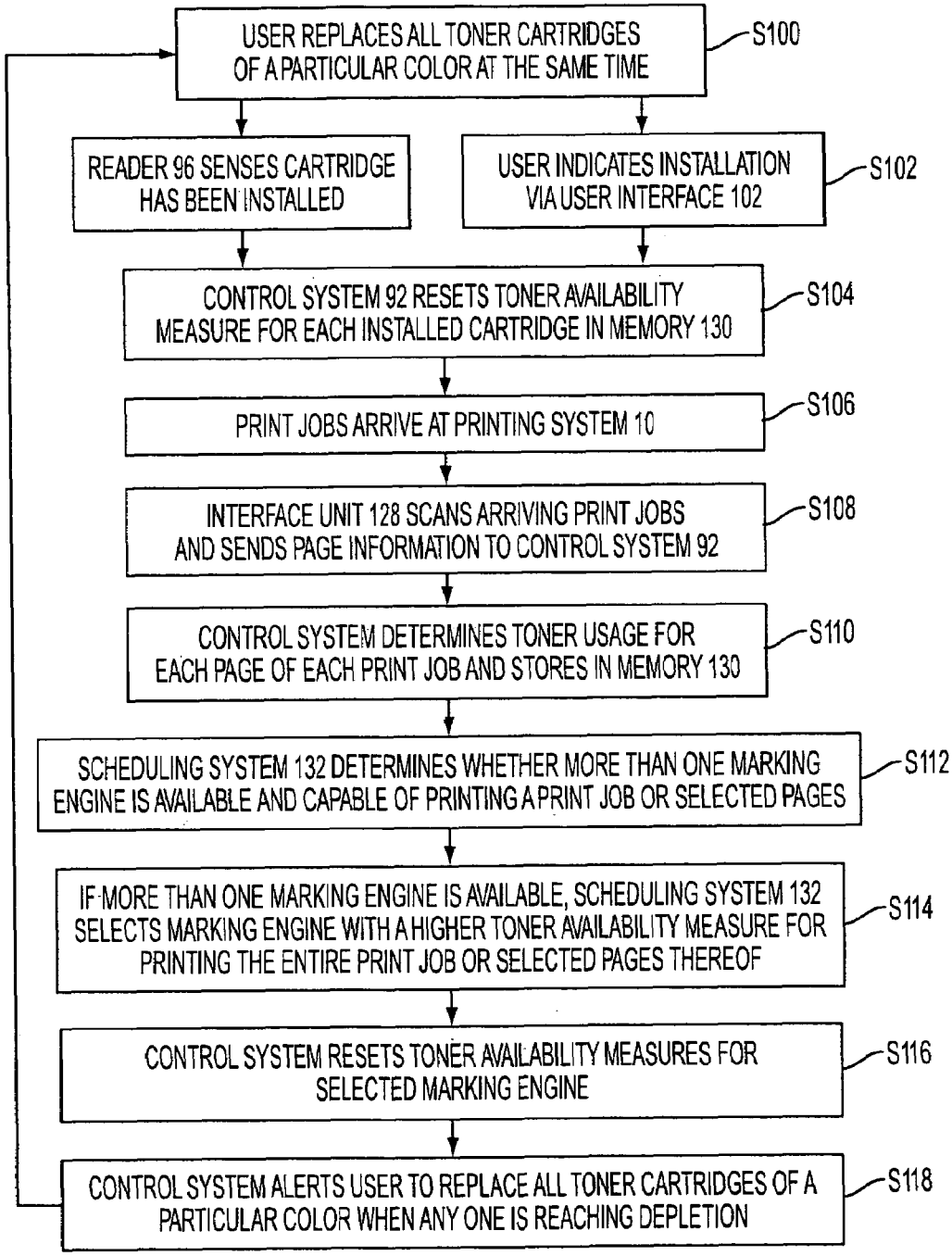
FIG. 4 is a flow diagram of an exemplary process for scheduling printing and replacement of toner cartridges in a printing system.

FIG. 4 shows the steps in an exemplary method of replacing cartridges and scheduling print jobs. As will be appreciated, the order of steps is not limited to the order shown and additional steps may be added or fewer than all the steps may be employed. At step S100, an operator of the printing system 100 replaces all toner cartridges of a particular color (e.g., C, M, Y or K) in the color marking engines 14, 16, 18 at the same time. At step S102 the reader 96 senses that a particular cartridge has been installed and communicates the information to the control system. Alternatively, the user identifies that an installation is complete via the user interface 102. At step S104, the control system 92 resets the toner level for each installed cartridge in memory 130. The toner is reset to a value which approximates the known toner level. At step S106, one or more print jobs arrive at the printing system 10. At step S 108, the interface unit 128 scans arriving print jobs and sends page information to the control system 92. At step S110, the control system determines the toner usage for each page of each print job based on the pixel count and stores the information in memory 130. Alternatively, the control system receives a measure of the available toner from the sensor 100, which is stored in the memory. The scheduling system 132 determines whether more than one marking engine is available and capable of printing a print job or selected pages of the job (step S112). If more than one marking engine is available, the scheduling system 132 may, operating in a balancing mode, select a marking engine with a higher toner level for printing the entire print job or selected pages thereof (e.g., those pages which have a relatively higher developed mass of the toner than other pages). For example, an entire print job may be assigned to a marking engine with a higher toner level or the print job may be split among two or more marking engines so as to balance toner usage (step S114). It will be appreciated that step S110 may be performed after assigning the pages to a particular printer (step S114), since the determination of toner consumption may vary, depending on which marking engine is selected. The control system 92 resets the toner levels for the selected marking engine or engines (step S116). When the control system 92 determines that a particular cartridge 76, 78, 80, 82 of any one of the color marking engines 14, 16, 18 is reaching depletion, the control system alerts the operator, e.g., via user interface 102, that the particular cartridge is reaching depletion (step S118). The operator may be instructed to replace all the toner cartridges of a particular color at the same time. The process then loops back to step S100.

The various processing components of the printing system, such as processor 98, marking engine CPUs 90, and control system 92 may be embodied in any suitable software or hardware. Moreover, the disclosed methods may be readily implemented as software executed on a programmed general purpose computer, a special purpose computer, a microprocessor, or the like. In this case, the methods and systems of the exemplary embodiments described herein can be implemented as a routine embedded on a microprocessor such as Java® or CGI script, as a resource residing on a server or graphics work station, as a routine embedded in a dedicated print management system, web browser, web TV interface, PDA interface, or the like.

U.S. Published Application Nos. 2004/0085561, 2004/0085561, and 2004/0088207 to Fromherz, published May 6, 2004, which are incorporated herein in their entireties by reference, disclose exemplary scheduling systems suited to use with a reconfigurable printing system. Such a scheduling system may be used to schedule the print sequence herein, by introducing consumable tracking functions. The scheduling system and model of the machine may also include features of the scheduler and model of the machine described in U.S. Pat. No. 5,617,214 to Webster, et al., incorporated herein by reference, except as otherwise noted.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a plurality of marking engines, each of the marking engines selectively receiving at least one replacement module comprising a consumable which is consumed during rendering of images by the marking engine, the consumable comprising a marking material; and a scheduling system which assigns images to the marking engines for rendering on a print medium, the scheduling system having a mode of operation in which images are selectively assigned to the marking engines to balance usage of the consumable by the marking engines, the scheduling system taking into account a level of the consumable for each of the plurality of marking engines, the level diminishing as the consumable is consumed, and assigning images to reduce a variation between the levels of the consumable.

2. The printing system of claim 1, wherein the consumable level comprises at least one of:

an estimate of the number of pages which the marking engine is capable of rendering with the consumable; and an amount of residual consumable.

3. The printing system of claim 2, wherein in the mode of operation, the scheduling system assigns images to the marking engines to reduce a variation between an estimate of a number of pages which the consumable associated with a first of the marking engines is capable of printing and an estimate of a number of pages which the consumable associated with a second of the marking engines is capable of printing.

4. The printing system of claim 2, wherein in the mode of operation, the scheduling system assigns images predominantly to a marking engine which has a higher consumable level than another of the plurality of marking engines.

5. The printing system of claim 1, wherein in the mode of operation, the scheduling system assigns images to the marking engines to reduce a variation between a time at which the consumable associated with a first of the marking engines is depleted to a predetermined level and a time at which the consumable associated with a second of the marking engines is depleted to a predetermined level.

6. The printing system of claim 1, wherein in the mode of operation, the scheduling system assigns images to the marking engines to reduce a rate of operator interventions for replacement of the replacement modules.

7. The printing system of claim 1, further comprising at least one output destination where pages of a print job are assembled in sequence and a conveyor system which links at least two of the plurality of marking engines with the output destination.

8. The printing system of claim 1, further comprising a source of the print medium and a conveyor system which links the plurality of marking engines with the source of print medium.

9. The printing system of claim 1, wherein the printing system is a xerographic printing system.

10. A printing system comprising:

a plurality of marking engines, each of the marking engines selectively receiving at least one replacement module comprising a consumable which is consumed during rendering of images by the marking engine;

a scheduling system which assigns images to the marking engines for rendering on a print medium, the scheduling system having a mode of operation in which images are selectively assigned to the marking engines to balance usage of the consumable by the marking engines; and a processing component which determines the consumable level for the consumable for each of the plurality of marking engines from bitmaps of the images assigned to each of the marking engines.

11. The printing system of claim 10, wherein the consumable comprises a marking material.

12. The printing system of claim 10, wherein the processing component reduces the consumable level for the marking engine to which the image is assigned.

13. A printing system comprising:

a plurality of marking engines, each of the marking engines selectively receiving at least one replacement module comprising a consumable which is consumed during rendering of images by the marking engine;

a scheduling system which assigns images to the marking engines for rendering on a print medium, the scheduling system having a mode of operation in which images are selectively assigned to the marking engines to balance usage of the consumable by the marking engines; and the consumable comprises a plurality of different colored marking materials and the scheduling system selectively assigns images to balance usage of the marking material color which is closest to depletion.

14. The printing system of claim 13, wherein the scheduling system takes into account a level of the consumable for each of the plurality of marking engines, the level diminishing as the consumable is consumed, and assigns images to reduce a variation between the levels of the consumable.

15. A storage medium comprising information for scheduling print jobs for printing by a plurality of associated marking engines, comprising:

information that for each of a plurality of images to be rendered:

stores a toner level for each of the associated marking engines; and assigns images to a selected one of the plurality of marking engines based on the toner levels, to balance usage of the consumable.

16. A method comprising:

for each of a plurality of marking engines, installing a replaceable module in the marking engine, the replaceable module comprising a consumable which is consumed during rendering of images by the marking engine;

selectively assigning images to the marking engines for rendering the images on print media, whereby consumption of the consumable is balanced among the marking engines; and alerting an operator to replace a plurality of the replacement modules when the consumable of one of the replacement modules is consumed.

17. The method of claim 16, further comprising:

tracking a level of the consumable for each of the marking engines;

selectively assigning images to reduce a variation between the levels of the consumable of each of the marking engines.

18. A printing system comprising:

a plurality of marking engines, each of the marking engines configured for rendering images by applying a marking material to a print medium;

a replaceable marking material cartridge associated with each of the marking engines which supplies the marking material to the marking engine, a level of the marking material diminishing as the marking material is applied to the print medium;

a processing component which tracks the levels of the marking materials for each of the marking engines; and a scheduling system in communication with the processing component which identifies marking engines which are available for rendering images and assigns the images to be rendered among the marking engines so as to reduce a variation between the levels of the marking material.

* * * * *